US005979787A

United States Patent [19]

Scarpa

[11] Patent Number: 5,979,787

[45] Date of Patent: Nov. 9, 1999

[54] APPARATUS AND METHOD FOR CONVERGENTLY APPLYING POLYMER FOAM TO SUBSTRATE

[75] Inventor: Jack G. Scarpa, Huntsville, Ala.

[73] Assignee: USBI Co., Kennedy Space Center, Fla.

[21] Appl. No.: 08/990,208

[22] Filed: Dec. 13, 1997

[51] Int. Cl.[6] ..... B05B 7/14

[52] U.S. Cl. ..... 239/9; 239/296; 239/419.3; 239/424

[58] Field of Search ..... 239/8, 9, 11, 13, 239/135, 296, 300, 418, 419.3, 422, 423, 424, 424.5, 430, DIG. 8; 118/308; 427/196, 421, 422, 426

[56] References Cited

U.S. PATENT DOCUMENTS

| | | | |
|---|---|---|---|
| 2,971,907 | 2/1961 | Peeps | 239/296 |
| 3,185,396 | 5/1965 | Black | 239/336 |
| 3,535,151 | 10/1970 | Raffel et al. | 239/418 |
| 3,837,575 | 9/1974 | Lehnert | 239/112 |
| 4,262,848 | 4/1981 | Chabria | 239/419.3 |
| 4,263,346 | 4/1981 | Sandell | 239/424 |
| 4,547,403 | 10/1985 | Smith | 427/196 |
| 4,673,594 | 6/1987 | Smith | 427/196 |
| 4,760,956 | 8/1988 | Mansfield | 239/8 |
| 4,809,909 | 3/1989 | Kukesh | 239/1 |
| 4,824,017 | 4/1989 | Mansfield | 239/9 |
| 4,967,956 | 11/1990 | Mansfield | 239/9 |
| 5,143,296 | 9/1992 | Saurwein et al. | 239/415 |
| 5,307,992 | 5/1994 | Hall et al. | 239/135 |
| 5,565,241 | 10/1996 | Mathias et al. | 427/196 |
| 5,579,998 | 12/1996 | Hall et al. | 239/9 |

*Primary Examiner*—Andres Kashnikow
*Assistant Examiner*—Lisa A. Douglas
*Attorney, Agent, or Firm*—Norman Friedland

[57] ABSTRACT

The invention is a system of spraying coating on the surface of a substrate with a convergent spray gun that utilized separate pump and flow metering systems. Each part of a two part resin is pumped and metered separately. The third part which is a foaming agent and surfactant is also pumped and metered separately in a mix chamber. All three materials are mixed in the mix chamber and then atomized and combined with dry filler in the convergent zone of the spray gun. The quantity of the filler and the three part foaming resins are proportioned in order to maintain a predetermined ratio.

6 Claims, 3 Drawing Sheets

10
12
14
14a
12a
24
18
16
44
46
56
126
78
AIR
76
20
38
42
40
32
30
36
34
28
26
60
72
70
HEX
HEX
HEX
88
66
58
68
86
PUMP
PUMP
PUMP
64
82
84
52
50
62
FOAMING AGENT
80

APPARATUS AND METHOD FOR CONVERGENTLY APPLYING POLYMER FOAM TO SUBSTRATE

TECHNICAL FIELD

This invention relates to coating technology and particularly to the apparatus and system of the convergent spray technology for applying coatings to a substrate for thermal and/or acoustic insulation treatment.

BACKGROUND OF THE INVENTION

Convergent spray apparatus is currently available and has been, for example, disclosed in U.S. Pat. No. 5,565,241 granted on Oct. 15, 1996 to Mathias et al entitled "Convergent End-Effector" and U.S. Pat. No. 5,307,992 granted on May 3, 1994 to Hall et al entitled "Method And System For Coating A Substrate With A Reinforced Resin Matrix" both of which include the inventor of the present invention, Jack G. Scarpa, as a named co-inventor and both of which are commonly assigned to USBI, Co. The U.S. Pat. Nos. 5,565,241 and 5,307,992 patents, supra, disclose apparatus for providing a convergent spray for applying the coating of reinforced resins matrix to a substrate is a spray nozzle that includes a centrally disposed orifice and a plurality of circumferentially spaced orifice(s) surrounding the center orifice for creating an atomizing zone. Included are other orifices radially spaced outwardly from these orifices which are used for shaping the spray. Reinforcing material is introduced to the resin through the aft end of an encircling chamber or manifold that surrounds the spray nozzle and is designed to feed the reinforcing material to the liquid resin. Pneumatic eductor lines for conducting compressed air are utilized to transport the materials to the substrate.

While these techniques have been described in the literature and are commercially available, there are no commercially available spray applications that can convergently apply a foaming thermal/acoustic insulation containing solid fillers.

I have found that I can provide a foaming thermal/acoustic insulation that contains solid fillers by combining a three part foaming resin system by supplying individually the mixed foaming resin and the selected solid fillers into a convergent nozzle. And then dynamically combines these ingredients externally of the spray nozzle through a convergent process. The system of the present invention contemplates heating the three part foaming resin in separate pressure containers in order to reduce the viscosity and allow for easier flow through metered liquid handling subsystems prior to entering the dynamic mixing chamber in the convergent nozzle.

This invention contemplates the use of a three part foaming resin system. Each part uses a separate pump and flow metering system. Part A epoxy resin and part B catalyst are pumped and metered separately to the resin mix chamber at the end of the convergent gun A third part foaming agent and surfactant is also pumped and metered separately to the mix chamber. All three materials are mixed in mix chambers and then atomized and combined with dry fillers in the convergent zone.

The convergent spray technique of this invention can be utilized in a multitude of applications of which several are listed hereinbelow and it is to be understood that this invention is not limited to the applications enumerated hereinbelow:

1) Thermal protection system (TPS) for application of aerospace vehicles for either thermal insulation or ablative insulation functions;

2) Smoke and flame retardant foam insulation products which could replace fiberglass insulation as for example in automotive, boats, trains and the like;
3) Acoustic insulation using recycled rubber as a filler;
4) structurally reinforced foam with greater stiffness than conventionally applied systems; and
5) cryogenic insulating systems for aerospace vehicles.

Without imposing any limitations, this invention has the ability of:

1. Adding a functional filler, such as granular cork and glass micro spheres, in high concentrations to sprayable foams for TPS type materials;
2. Controlling the thickness of the applied coating by virtue of either the process or the formulation;
3. Matching dimensions of area to be coated on the substrate, thereby minimizing waste and over spray;
4. Controlling the composition of the coating by controlling both filler and resin material independently;
5. Providing significantly reduction in waste and hazardous materials;
6. Providing flexibility in substituting different resins and fillers; and
7. Enhancing the strength and elongation of the coating.

DISCLOSURE OF THE INVENTION

An object of this invention is to provide a convergent spray apparatus for coating a substrate with a foaming thermal/acoustic insulation containing solid fillers.

A feature of this invention is a convergent spray technique to spray onto a substrate a coating that includes a foaming thermal and/or acoustic insulation material which material may include solid fillers, such as verniculate, perlite, ground rubber, cork, etc.

A feature of this invention is a three part foaming resin system that injects all three components into the dynamic mixing chamber in the convergent nozzle and injecting the dry filler component into the convergent stream exterior of the nozzle and maintaining a constant filler to liquid resin ratio and manually or automatically applying the coating to the substrate. The invention contemplates either a three part foaming resin system or a two part foaming system. Either system contemplates applying the coating to the substrate manually or automatically.

Another feature of this invention is that the system provides for delivery, metering and mixing of the required components in proper ratios to the convergent applicator.

The foregoing and other features of the present invention will become more apparent from the following description and accompanying drawings.

These figures merely serve to further clarify and illustrate the present invention and are not intended to limit the scope thereof.

BEST MODE FOR CARRYING OUT THE INVENTION

As was mentioned in the above paragraphs that this invention is adapted for many applications and is flexible to utilize numerous ingredients in making up the coating composition, it is to be understood that the invention is not limited to the applications noted in this patent application and as one skilled in the art will appreciate this invention has a wide latitude of applications.

Figure 1:
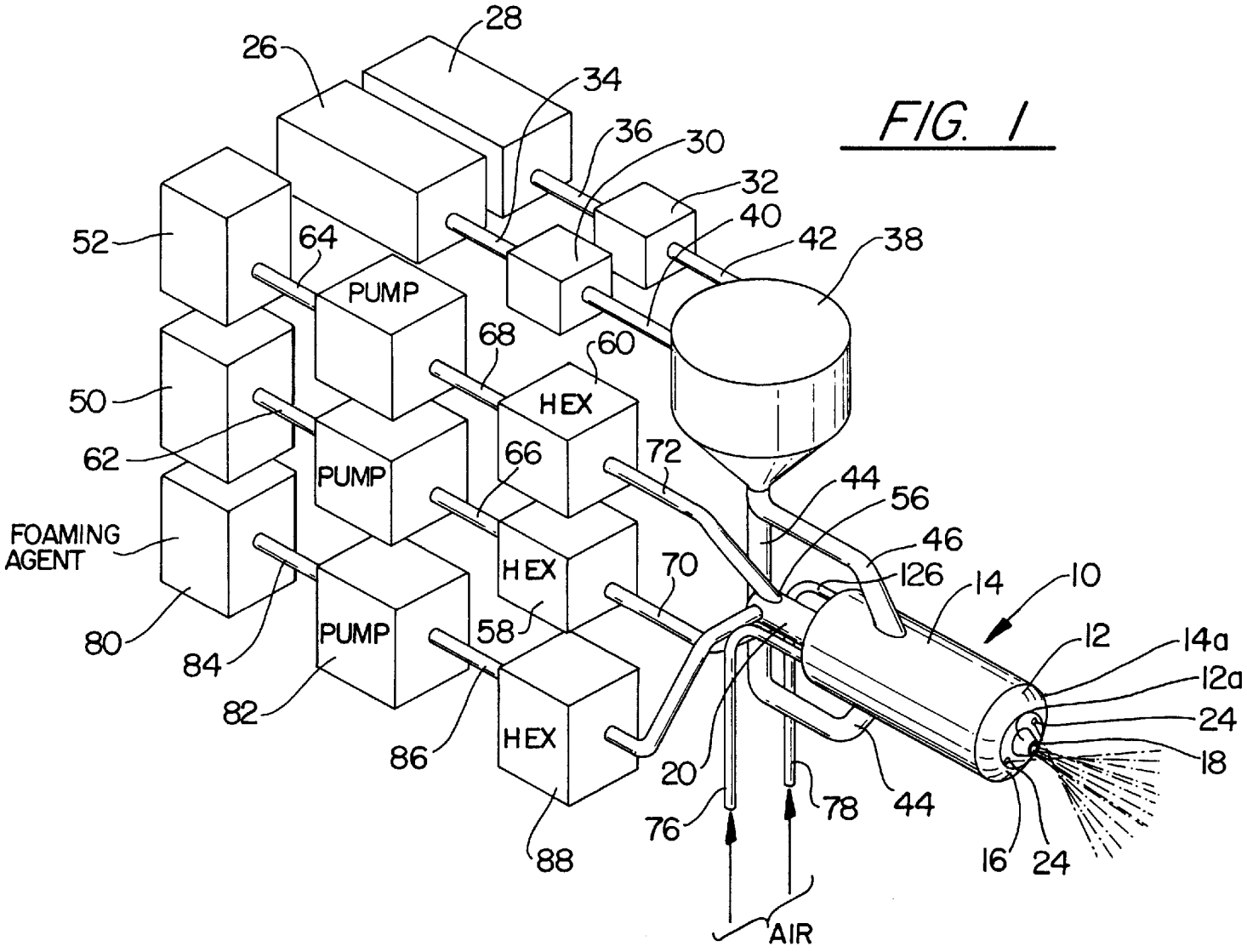
FIG. 1 is a schematic illustration of the spray gun and system of this invention.
Figure 2:
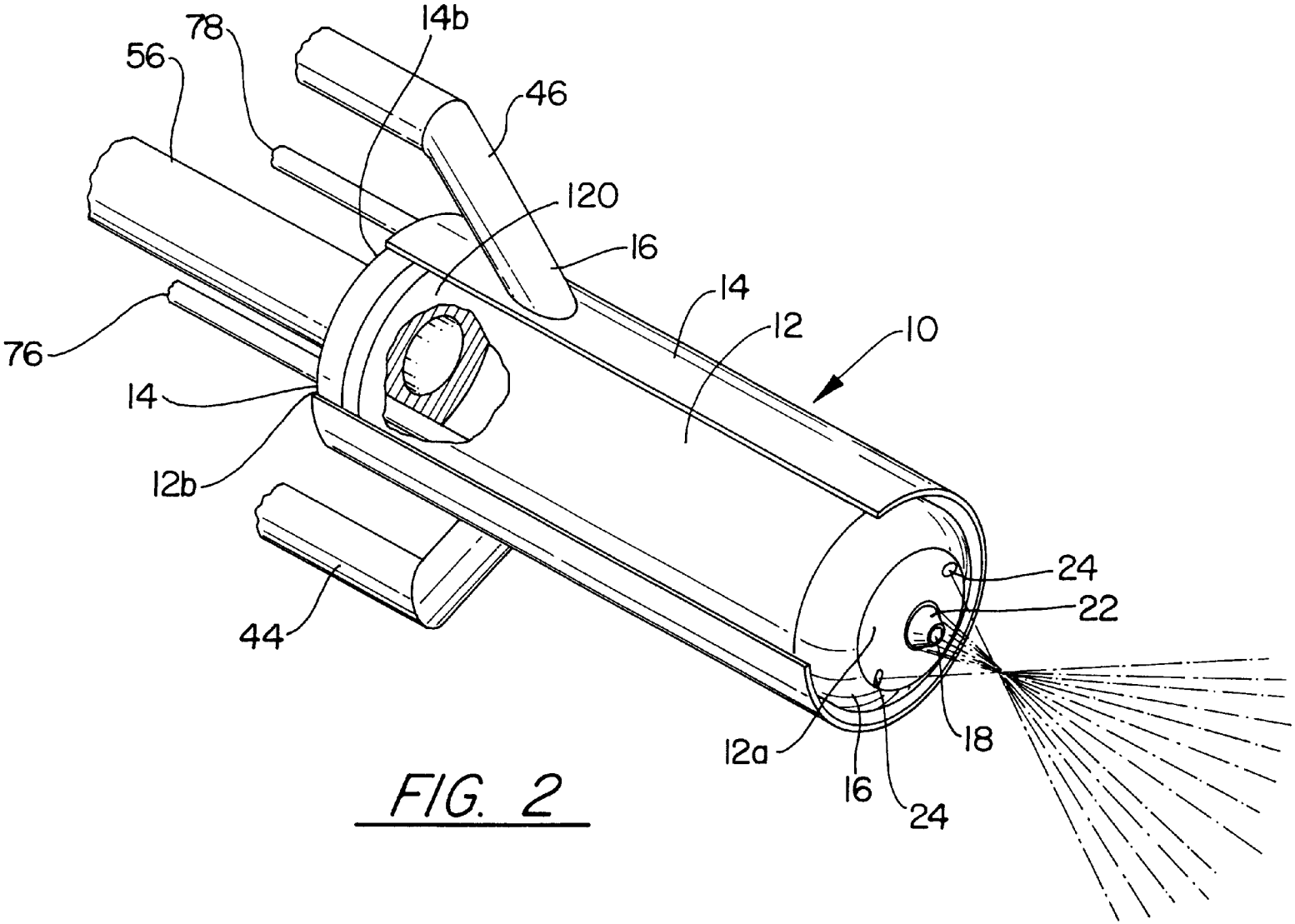
FIG. 2 is a view in elevation partly cut away to show the details of the present invention.

The invention is best understood by referring to FIGS. 1 and 2 which illustrate the convergent spray gun generally illustrated by reference numeral 10 as being comprised of the substantially cylindrically shaped hollow inner housing 12 being closed at the fore end 12*a* by the end cap 16 and closed at the aft end 12*b*. The concentrically mounted outer housing 14 surrounding cylinder 12 is opened on the fore end 14*a* and closed on the aft end 14*b* and is spaced from cylinder 12 for defining therewith annular passage 22. The end cap 16 defines the nozzle of the spray gun and includes a central orifice 18 that communicates with the hollow cylinder 12 which serves to conduct liquid resin thereto. Pipe 20 extending from the aft end of cylinder 12 serves to mix the ingredients of the resin and foaming agent being admitted thereto as will be described hereinbelow.

The end cap 16 includes an annular passage 22 surrounding the central orifice 18 and a pair of shaping holes 24 located on the outer periphery of end cap 16. For details of the spray gun and operation thereof reference should be made to U.S. Pat. Nos. 5,565,241 and 5,579,998, supra which are incorporated herein by reference. Suffice it to say that the spray gun produces a convergent atomized stream of fine particles of the liquid resin and the filler material is injected into the stream to mix therewith on the exterior of the spray gun. The shaping holes, which serve to inject a stream of pressurized air toward the convergent spray to shape the spray to meet the demands of the shape of the surface of the substrate being coated. This invention utilizes a portion of the teachings detailed in the above referenced patents and builds on this technique in order to introduce a foaming agent to the coating ingredients so as to obtain the insulation characteristics as was described herein above.

As disclosed in the U.S. Pat. No. 5,565,241 patent, supra, the two reinforcing materials in supply 26 and 28 are conveyed to the eductors 30 and 32, respectively, through lines 34 and 36, respectively and delivered to the cyclonic mixer 38 via lines 40 and 42, respectively. The mixed ingredients of the reinforcing materials are then discharged from the cyclonic mixer 38 via line 44 and branch line 46 to be admitted into the spray gun and annular passage 22 to be introduced to the liquid resin in the convergent spray exiting from central orifice 18. The air required to provide the mixing and atomization is introduced into the spray gun via lines 76 and 78.

The liquid resin in the supply 50 and 52 is pumped into the mixing chamber 56 communicating with the central hollow portion of cylindrical member 12, but first flowing through the heat exchangers 58 and 60, respectively via lines 62, 64, 66, 68, 70 and 72. The liquid resin is atomized and converged by the spray gun nozzle and either manually or automatically applies the coating to the surface of the substrate as explained in the U.S. Pat. No. 5,565,241 patent, supra. The shaping holes are optionally and may be utilized in applications where the shape of the surface of the substrate would require a unique shape of the spray emitted from the spray gun.

In accordance with this invention a foaming agent, as for example a siloxane composition, is utilized and shown as being stored in the box 80. The pump 82 flows the foaming agent to the spray gun 10 through lines 84 and 86 through the heat exchanger 88 and into the mixing chamber 56 of the spray gun. At this point the foaming agent is mixed with the liquid resin and atomized therewith to form the convergent spray. In this example, the reinforcing material mixed in the cyclonic mixer 78 is granular cork and glass micro spheres. The resin is an epoxy compound and the foaming agent is a siloxane and includes a suitable surfactant. The heat exchanger may take the form of a suitable heating blanket that serves to heat the ingredients in order to obtain the desired viscosity in order to facilitate the operation of the gun and assure that a consistent coating is obtained. In actual test specimens utilizing these ingredients, the foam coating exhibited a density and strength of 24.6 pounds per cubic feet density and the flatwise tensile strength was 370 pounds per square inch on average.

Figure 3:
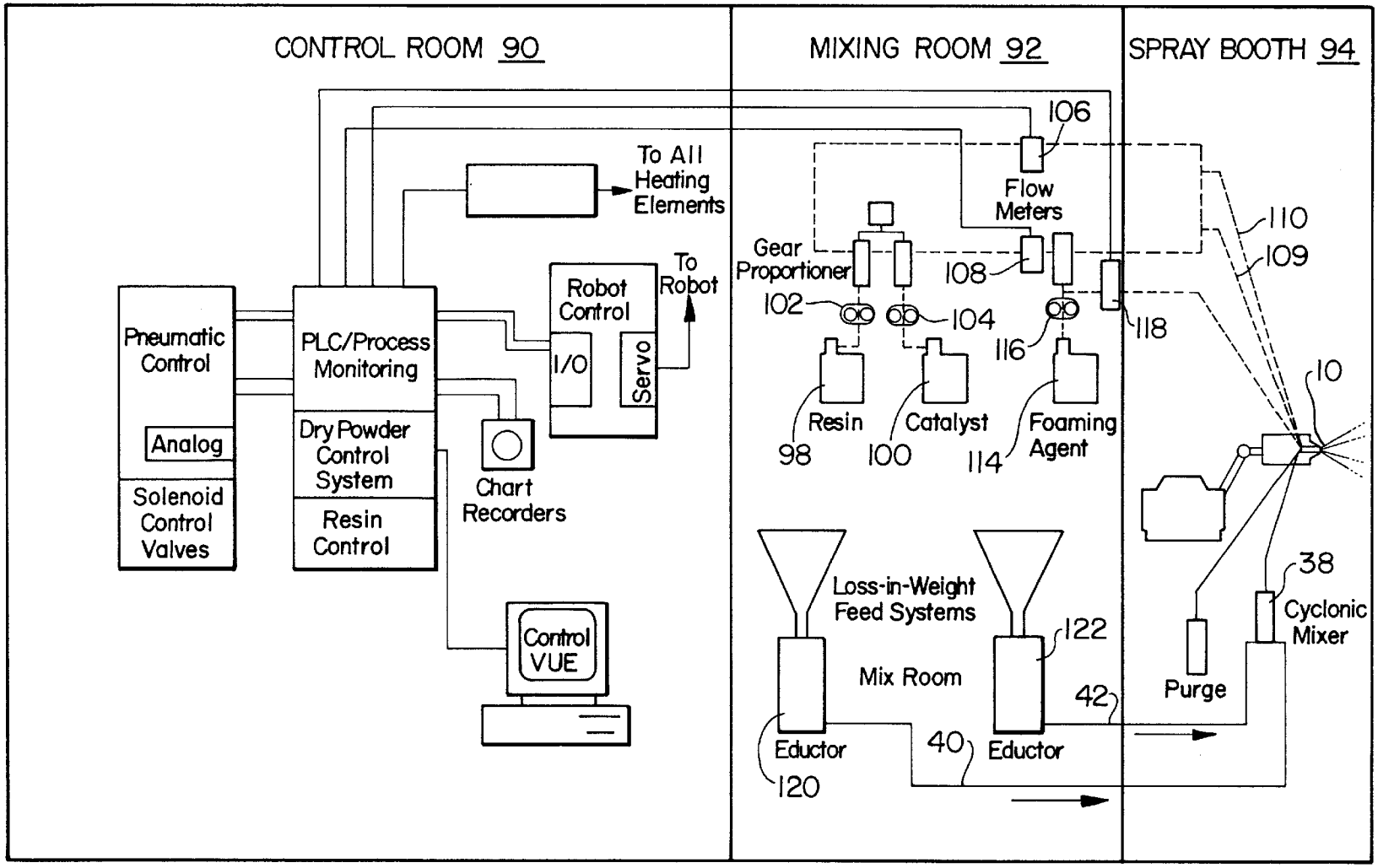
FIG. 3 is a schematic view illustrating the method of controlling, mixing, proportioning, metering and applying the coating to the substrate in accordance with this invention.

According to this invention, in order to attain the desired foam coating it is necessary to maintain a constant dry filler to liquid resin ratio to assure a consistently applied foam coating formulation. This is achieved by providing a dust free mixing room for mixing the ingredients and utilizing a general purpose computer and PLC process control for controlling the mechanical devices for mixing, metering, pumping and transporting the materials to the spray gun. As shown in FIG. 3 the system is divided into three separate room or areas, namely, the control room 90 with the necessary controls including the computer, the PLC processor, the pneumatic control for the atomized air, fan air and conveyor air, the solenoid control valves operating the gun trigger, the purge or flush mechanism, cork air, glass air, resin A and resin B, the mixing room 92 and the spray booth 94. The program for controlling the atomized air, fan air, conveyor air, gun trigger, the cork air, glass air, the two resins A & B is well known technology that is capable of being programmed by any skilled computer programmer. The controls, solenoid valves, pneumatic controls and heating element control for effectuating the mixing and moving of the ingredients that are mixed in the mixing room 92 are also well known mechanism and are commercially available such that one of ordinary skill can practice this invention.

The resin A and B (catalyst) are stored in containers 98 and 100 and by suitable pumps 102 and 104, respectively are conducted to the flow meters 106 and 108 where the amounts are metered before being delivered to the spray gun via lines 108 and 110. A suitable gear proportioner serves to assure that the desired quantity of each of these ingredients are properly proportioned. The foaming agent is stored in container 114 and is pumped by pump 116 to the flow meter 118 and conducted to the spray gun through line 120. The amount of foaming agent is determined by the flow meter 122 which is controlled by the PLC process control to assure that the proper amounts are delivered to the spray gun. The filler material is delivered to the spray gun through the eductors 120 and 122 and the loss-in-weight feed systems in the same manner as described in the U.S. Pat. No. 5,565,241 patent. While the spray gun in the spray booth 94 is automatically controlled by a suitable robot also controlled by the PLC process control, it will be appreciated that the spray gun could also be triggered manually.

As was disclosed herein above, the thermauacoustic foam coating system provides for individual supply of the mixed foaming resin and the selected solid fillers into a convergent nozzle through a convergence process. The two part resin systems may be heated in separate pressure containers to reduce viscosity and allow for easier flow through the metered liquid handling sub-system prior to entering the dynamic mixing chamber in the convergent nozzle. It will be understood by those skilled in this art, that the system may also be reduced to a two part resin system by adding foaming components to the resin side of the system and thus, eliminating the foaming agent pump and metering system.

The dry filler component, an acoustic and or therma/acoustic material is stored in special hoppers and fed to a gravimetric or volumetric feed subsystem under controlled conditions into an air supply stream which transports it to the applicator. The sub-system maintains a constant dry filler to liquid resin ratio to assure a consistently applied foam coating formulation.

Following the complete blending of the liquid resin components with the dry filler component, the resulting coating mixture is uniformly applied either manually or automatically recognizing that the automatic application is preferred since this type of equipment of a controlled robot will allow a more precisely controlled application with a consequential improvement with regard to thickness and surface finish. The system described by this invention provides for delivery, metering and mixing the required components in proper ratios only on demand of the convergent applicator thereby eliminating the requirement to pre-mix the coating formulations. The convergent spraying of selected fillers and resins provides a consistent and controllable insulating coating. Heating of the separate resins accelerates the gel times of the sprayed materials thus allowing a faster build up of the coating.

The polymer based foam may be an epoxy based material or epoxy-urethane based material. The filler material is selectable depending on the application of the foam product and may be a fire-retardant, an extending (non-functional) agent, or a strengthening agent (i.e. fibers). The unique aspect of this invention is the capability to add these materials in a mix-on-demand manner, through a spray process, creating a material structure not achievable by conventional means.

Although this invention has been shown and described with respect to detailed embodiments thereof, it will be appreciated and understood by those skilled in the art that various changes in form and detail thereof may be made without departing from the spirit and scope of the claimed invention.

I claim:

1. A convergent spray gun for applying a coating to a substrate including a spray nozzle for directing liquid resin toward the substrate, a liquid resin supply, said nozzle having an orifice and an atomizing hole adjacent to said orifice for atomizing the liquid resin and forming a convergent spray, a line for interconnecting said liquid resin supply and said orifice, an outer housing coaxally disposed around said conduit and defining therewith an annular passage having a discharge end adjacent to said orifice, a reinforcing material supply, conduit means interconnecting said reinforcing material supply and said discharge end for admitting reinforcing material into said atomized liquid resin, the improvement comprising a supply of foaming agent, means for leading said foaming agent to said liquid resin immediately upstream from said orifice, a mixing chamber, said line and said means for leading foaming agent connected to said mixing chamber for mixing said liquid resin and said foaming agent prior to being delivered to said orifice.

2. A convergent spray gun for applying a coating to a substrate as claimed in claim 1 including an eductor for moving the reinforcing material from said reinforcing supply through said conduit and past said nozzle for being admitted into said convergent spray.

3. A convergent spray gun for applying a coating to a substrate as claimed in claim 2 including flow meter means for metering the quantity of said resin and said foaming agent and a loss-in-weight feed system for said eductor for controlling the ratio between said reinforcing material and said foaming agent and resin.

4. A convergent spray gun for applying a coating to a substrate as claimed in claim 3 wherein said resin is an epoxy compound.

5. A convergent spray gun for applying a coating to a substrate as claimed in claim 3 wherein said foaming agent is a siloxane compound.

6. A method for coating a substrate comprising the steps of:

introducing a liquid resin to a mixing chamber connected to a nozzle having an orifice and an atomizing mechanism, ii. creating an area of low pressure by passing the liquid resin through the orifice and atomizing the liquid resin with a gas passing through the atomizing mechanism;

iii. introducing reinforcing filler material into a cavity surrounding the mixing chamber and carrying the reinforcing filler material past the nozzle such that the low pressure area causes the reinforcing filler material to be drawn into to converge eith the liquid resin prior to contacting the substrate;

iv. introducing a foaming agent to the liquid resin in the mixing prior to being flowed to the orifice in step i; and v. contacting the mixtre of resin, foam and reinforcing filler material with the substrate by spraying through said nozzle.

* * * * *

UNITED STATES PATENT AND TRADEMARK OFFICE

CERTIFICATE OF CORRECTION

PATENT NO. : 5,979,787

DATED : November 9, 1999

INVENTOR(S) : Jack G. Scarpa

It is certified that error appears in the above-identified patent and that said Letters Patent is hereby corrected as shown below:

On column 6, line 44, after "mixing" insert --chamber--

Signed and Sealed this

Sixth Day of March, 2001

Nicholas P. Godici

*Attest:*

NICHOLAS P. GODICI

*Attesting Officer*

*Acting Director of the United States Patent and Trademark Office*